US005497906A

United States Patent [19]

Dubach

[11] Patent Number: 5,497,906

[45] Date of Patent: Mar. 12, 1996

[54] PLASTIC CLOSURE WITH SECURITY ELEMENT

[75] Inventor: Werner F. Dubach, Maur, Switzerland

[73] Assignee: Createchnic AG, Switzerland

[21] Appl. No.: 101,439

[22] Filed: Jul. 30, 1993

[30] Foreign Application Priority Data

Aug. 6, 1992 [CH] Switzerland ..... 02467/92

[51] Int. Cl.[6] ..... B65D 55/02

[52] U.S. Cl. ..... 222/23; 215/241; 215/253; 215/258; 220/266; 222/153.06; 222/546; 222/556

[58] Field of Search ..... 222/153, 541, 222/23, 556, 546, 153.14, 153.05, 153.06, 541.6; 215/214–216, 237, 224, 235, 220, 254, 241, 250, 253, 258; 220/306, 307, 375, 266, 270, 339; 206/807

[56] References Cited

U.S. PATENT DOCUMENTS

| | | | |
|---|---|---|---|
| 3,441,161 | 4/1969 | Van Baarn . | |
| 4,127,221 | 11/1978 | Vere | 222/153 |
| 4,244,495 | 1/1981 | Lorscheid et al. | 222/153 |
| 4,334,639 | 6/1982 | Gach . | |
| 4,344,545 | 8/1982 | Aschberger et al. | 220/266 X |
| 4,371,088 | 2/1983 | Gach | 215/220 |
| 4,407,423 | 10/1983 | Walter | 220/260 |
| 4,487,324 | 12/1984 | Ostrowsky . | |
| 4,519,517 | 5/1985 | Walter | 215/253 |
| 4,610,371 | 9/1986 | Karkiewicz | 222/153 X |
| 4,658,980 | 4/1987 | Lindstrom | 220/254 X |
| 4,696,408 | 9/1987 | Dubach . | |
| 4,711,372 | 12/1987 | Gach | 222/153 X |
| 4,717,033 | 1/1988 | Dubach . | |
| 4,722,449 | 2/1988 | Dubach . | |
| 4,778,072 | 10/1988 | Newman | 222/153 X |
| 4,782,964 | 11/1988 | Poore et al. . | |
| 4,795,044 | 1/1989 | Beck . | |
| 4,869,399 | 9/1989 | Dubach . | |
| 4,941,592 | 7/1990 | Kitterman | 222/153 X |
| 4,949,883 | 8/1990 | Dubach . | |
| 5,069,367 | 12/1991 | Salmon et al. . | |
| 5,083,671 | 1/1992 | Hayes . | |
| 5,094,361 | 3/1992 | Dubach . | |
| 5,115,931 | 5/1992 | Dubach . | |
| 5,141,138 | 8/1992 | Odet et al. . | |
| 5,147,054 | 9/1992 | Pehr . | |
| 5,221,017 | 6/1993 | Cistone et al. . | |

FOREIGN PATENT DOCUMENTS

| | | |
|---|---|---|
| 0141591 | 5/1985 | European Pat. Off. . |
| 2633590 | 1/1990 | France . |
| 3442152 | 6/1985 | Germany . |
| 212300 | 7/1974 | Spain . |

*Primary Examiner*—Kevin P. Shaver
*Attorney, Agent, or Firm*—Speckman, Pauley & Fejer

[57] ABSTRACT

A one-piece plastic closure for fastening on a container having a lower part with a top surface which forms a pouring opening, and a cap pivotably connected to the lower part by a hinge shaft. A security element is connected to the closure such that, during initial opening of the closure, the security element is transformed from a secured state to a visually recognizable state of use.

31 Claims, 8 Drawing Sheets

PLASTIC CLOSURE WITH SECURITY ELEMENT

BACKGROUND OF THE INVENTION

1. Field of the Invention

This invention relates to a one-piece plastic closure for fastening on a container comprising a lower part with a top surface in which a pouring opening is disposed, a cap pivotably connected thereto by a hinge shaft, and a security element connected in one piece to the closure.

2. Description of Prior Art

Plastic closures of the type mentioned above are known in many embodiments. See, for example, U.S. Pat. No. 3,441,161 and 4,487,324. As a rule, plastic closures with a lower part and a cap pivotably connected thereto by a hinge shaft always employ security bands which must be removed prior to the initial opening movement. The '161 patent discloses a bottle closure wherein the bottleneck itself constitutes the pouring opening and wherein the lower part thus only comprises an annular wall with a clamping bead which is connected in one piece to the tang-like upper part, a top surface being omitted. Only by the removal of the security band are the upper part and the lower part separated from each other with the exception of a remaining part used as a hinge shaft. Although such a closure can be manufactured without problems, it must be molded in the closed position, which makes the formation of the lower part with a top surface and a pouring opening disposed therein impossible. The '324 patent teaches a one-piece closure having a lower part with a top surface in which a pouring opening is disposed, a cap pivotably connected to the lower part by a hinge shaft and a security element connected in one-piece to the closure. A closure of this type is molded in the open position. In this case, the security element also is a security band disposed on the lower part which has recesses distributed over its circumference which, in the security position, are engaged by protrusions in the cap.

A similar plastic closure is also taught by U.S. Pat. No. 4,696,408. Here, too, it is first necessary to tear off a security band before the closure can be opened. In contrast to the solution in accordance with the '324 patent, this security band does not operate primarily by a positive fit which makes the initial opening impossible prior to the removal of the security band, but rather the security band makes it impossible to grip the cap as long as the security band is still disposed on the closure.

In contrast to screw closures having a security ring at one end which is connected to an annular wall of the screw cap by predetermined break points and which engage the back of an annular bead on the bottleneck, it is necessary in connection with all known plastic closures having a lower part with a top surface in which a pouring opening is disposed and having a cap pivotably connected thereto by a hinge shaft to perform an additional manipulative step prior to the initial opening movement.

Manufacture of a one-piece plastic closure as described above, having a security band, is extremely problematical. For one thing, the security bands often tear when being removed from the injection mold because they get caught in the cavities of the injection mold. In addition, the long and thin security bands have a tendency to deform, as a result of which initial closing is either made impossible or the security band tears at some of the predetermined break points during initial closing. Also, plastic closures with a security band are not esthetically pleasing. Although guaranteed secure closures are being demanded by the cosmetics industry, the known guaranteed secure closures with a security band have not been successful.

It has also been shown that many users still do not understand the function of security bands and try unsuccessfully to open the closure without removing the security band. For this reason, such closures are still wrongly torn off or unscrewed.

SUMMARY OF THE INVENTION

Accordingly, it is an object of this invention to provide a one-piece plastic closure as previously described with a security element which does not require an additional manipulation prior to initial opening. It is a further object of this invention to provide a one-piece closure which overcomes the above-cited disadvantages.

These objects are attained by a one-piece plastic closure comprising a lower part with a top surface in which a pouring opening is disposed, a cap pivotally connected by a hinge shaft to the lower part and at least one security element connected in one-piece to the closure. At least one of the security elements is disposed on the closure such that it can automatically be brought from a secured state to a visually recognizable state of use during the initial opening movement of the entire cap away from the lower part of the closure and/or of the entire closure away from the container.

In accordance with one embodiment of this invention where the one-piece plastic closure is screwable on a container having an outwardly circularly extending fastening bead on the container neck and where at least one security element is in operational contact in a positively locking manner with the fastening bead on the container neck, said security element has a dual function, making the initial opening movement of the cap as well as unscrewing of the entire closure from the container visually recognizable.

BRIEF DESCRIPTION OF THE DRAWINGS

These and other objects and features of this invention will be better understood from the following detailed description and the exemplary embodiments shown in detailed form in the drawings wherein.

DESCRIPTION OF PREFERRED EMBODIMENTS

Figure 1:
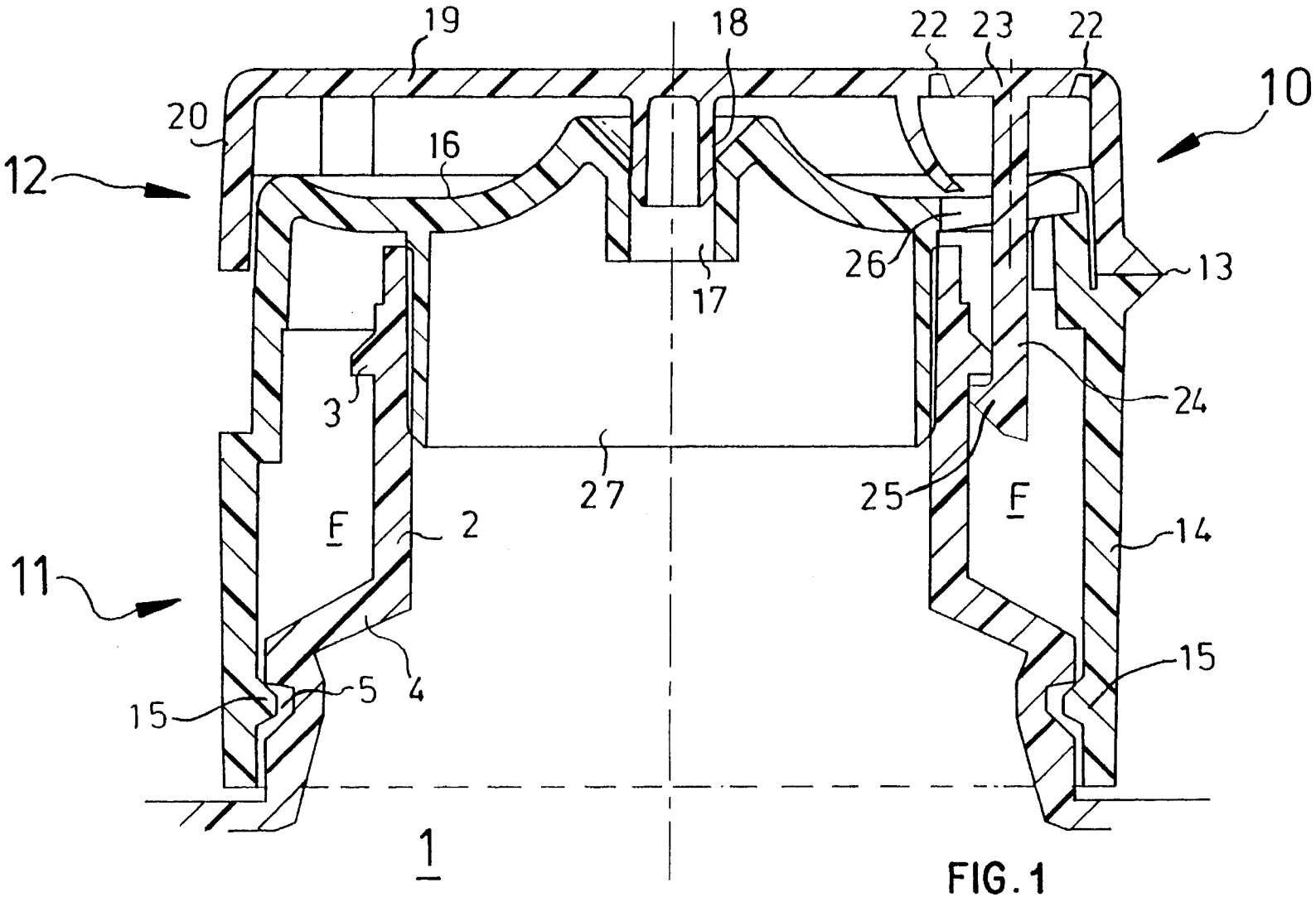
FIG. 1 is a cross-sectional side view through a one-piece plastic closure with a security element in the secured state in accordance with one embodiment of this invention.
Figure 2:
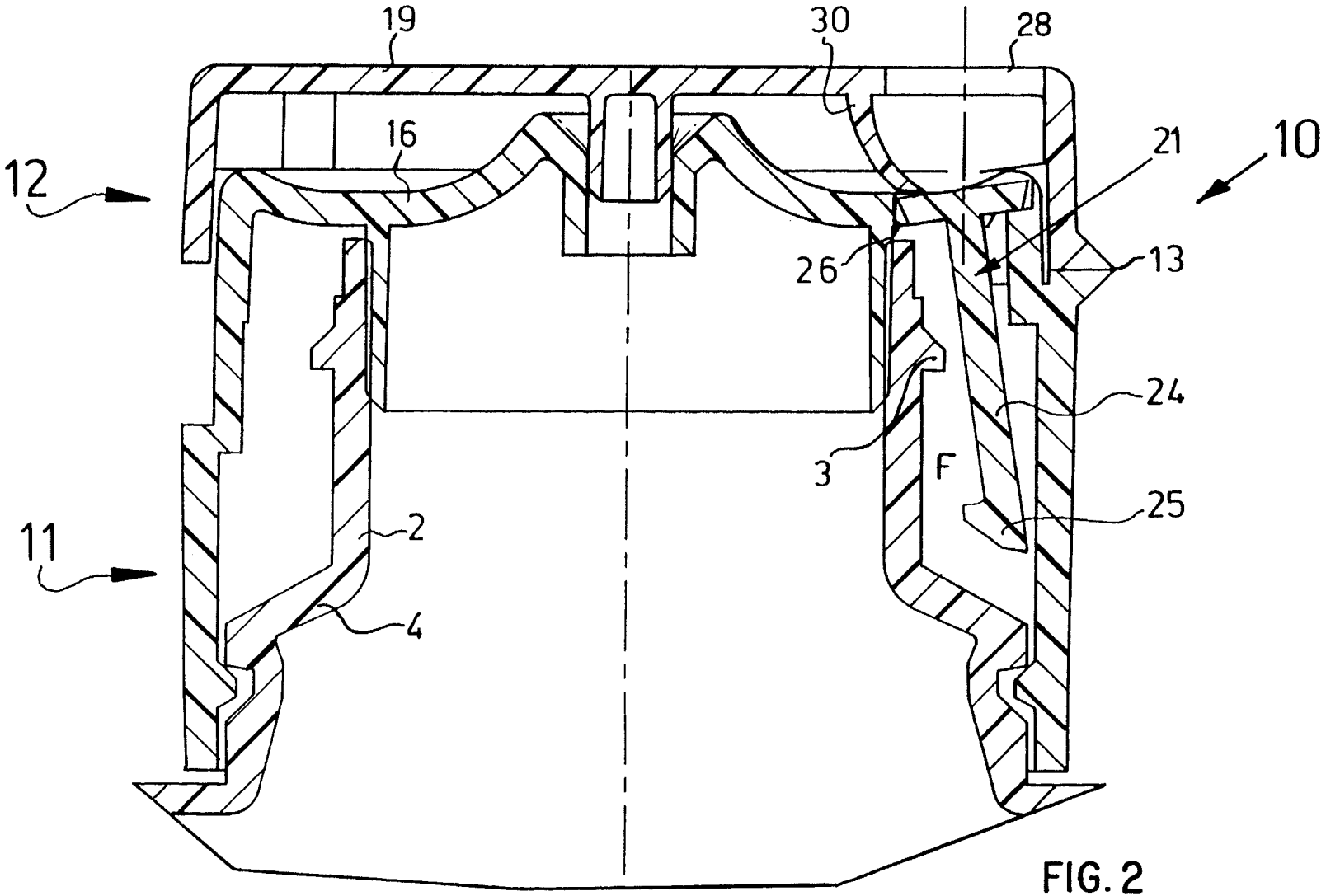
FIG. 2 is a cross-sectional side view of the closure shown in FIG. 1 following the performance of the initial opening movement and in the state of use.

A particularly preferred embodiment of a plastic closure in accordance with this invention is shown in FIGS. 1 and 2. This embodiment is particularly preferred because the security element can be undone using two different opening movements. Such a closure, which can deviate from a round shape, is particularly suitable for placement on blown plastic bottles which may have a container neck with a special shape. Such a container 1 has a cylindrical container neck 2 which, in the area of its upper end, has an outwardly facing annular fastening bead 3 which in this case has a hook-shaped cross section. The transition area 4 between the container neck 2 and the actual container 1 has a shape which deviates from a round shape. Thus, the closure forced on the container 1 can be unscrewed.

The embodiment of the container neck shown in FIGS. 1 and 2 is by no means required. For example, the transition area 4, which must have a larger diameter than the container neck 2, can also be cylindrical and have an exterior thread the same way as the container neck 2. It is then possible to screw or press a cylindrical closure, which otherwise has the same mode of functioning and embodiment as the closure illustrated in FIGS. 1 and 2, on a container neck designed in such a way.

The closure 10 has a lower part 11 and a cap 12 connected to the lower part by a hinge shaft 13. The hinge shaft 13 is preferably constituted as a film hinge. However other hinge shafts which are movable, such as strips, can also be used. The lower part 11 has an annular casing wall 14 supported in a force- and/or positively-locked manner on the transition area 4 of the container 1. Appropriate clamping beads are provided on the interior wall side of the casing for this purpose. If the closure is cylindrical, the casing wall 14 can be provided with an interior thread instead of the clamping beads. However, it is essential that the casing wall 14 encloses the upper area of the container neck 2 at a distance from a container neck 2 and in this way forms free space F between container neck 2 and casing wall 14. The lower part 11 is closed off at the top by a top surface 16 having a pouring opening 17. In the closed state of the closure 10, a sealing tang 18 disposed on the underside of the cap 12, engages the pouring opening 17. The cap 12 also has a top surface 19 and an annular casing wall 20 abutting on the top surface 19. In the closed state of the closure, the casing wall 20 of the cap 12 or the casing wall 14 of the lower part 11 are positioned at least approximately vertically atop each other. However, this is not required because the entire closure 10 can also have a conicity. A security element 21 is maintained in the top surface 19 of the cap 12 in the form of predetermined break points 22 in the shape of bars. The security element 21 has a sealing surface in the shape of a small plate 23, on the underside of which a bar 24 is formed. The lower end of the bar 24 is provided with a positive locking means 25 in the form of a hook or a protrusion. In the exemplary embodiment shown, the top of the small plate 23 constituting the seal is flush with the top of the top surface 19 of the cap 12. A recess 26 is formed in the top surface 16 of the lower part 11, which recess 26 is located underneath the small plate 23 and through which the bar 24 extends below the top surface 16 and as far as below the fastening bead 3 on the container neck 2. In this way, the bar 24 extends into the free space F. It is obvious that the lower part 11 must be sealed with respect to the container neck 2, for which purpose an annular wall 27 sealingly extending into the container neck 2 and surrounding the pouring opening 17 is provided on the underside of the top surface 16. The recess 26 penetrates only through the top surface 16 of the lower part 11 in the area between the casing wall 14 and the sealed annular wall 27 and subsequently can only communicate with the free space F.

The closure in accordance with one embodiment of this invention is shown in the state of use in FIG. 2. The closure attains this state by an initial opening movement. This general way of expressing this is based on the fact that the security element 21 is changed from a secured state to a state of use independently of the type of opening. In the normal case, the user would open the cap 12 by pivoting it around the pivot shaft 13. In this case, the top surface 19 of the cap 12 moves upwards with respect to the lower part 11 or the container neck 2. In this case, the positive locking means 25 now engages the lower end of the bar 24 at the fastening bead 3 of the container neck 2. With the continuing opening movement, the predetermined break points 22 tear and the security element 21 falls downward, because it is no longer held in the cap 12. This is possible due to free space F having sufficient space for the bar 24. It can therefore be observed through the opening 28 in the top surface 19 of the cap, which is now exposed, that the closure 10 is no longer in the secured position.

An opening movement of the entire closure 10 has the same effect. If the closure 10 is designed as a screw closure, it is turned with respect to the container 1 or the container neck 2 during the initial opening movement of the entire closure 10. During the initial opening movement, the positive locking means 25 on the bar 24 initially glides only along the lower edge of the fastening bead 3, whereupon the positive locking means 25 again engages the back of the fastening bead in the course of the subsequent upward vertical movement of the closure 10 and the predetermined break points 22 tear. Here, too, the entire security element 21 falls into a lower position and frees a hole 28 in the top surface 19 of the cap 12.

After initial opening, because the security element 21 has performed its actual function, it can be easily removed. However, if the recess 26 is designed in such a way that it is possible to maintain the small plate 23, which in the secured state is used as a seal, in a positively- and/or forced locked manner in it, the security element now takes on an esthetic task in that it covers the recess 26 elegantly. In the simplest case, it is possible to push the security element 21 manually into the recess 26 after the cap 12 is initially opened. However, because many users do not arrive at this conclusion, a baffle 30, for example in the shape of a spring arm, may be provided on the underside of the top surface 19 of the cap 12. As a result, during the course of the initial opening movement of the cap 12, this baffle 30 will automatically press on the small plate 23 during the subsequent closing process and press it into the recess 26.

The embodiment herein described is therefore absolutely fool-proof in its function and makes a wrong manipulation impossible. Because of the functional connection between the security element 21 and the container 1 provided in this construction, it is not possible to separate the entire closure 10 from the container 1 without the security element being visibly changed from the secured state to the state of use. The requirement for closures which permit opening by means of a cap as well as by the complete separation of the closure from the container has risen lately particularly because it is often required that plastic containers need to be refillable. In spite of this, a large number of closures are also required for containers which cannot be refilled, in which, therefore, an opening movement between the closure and the container does not occur at all. In such cases, it is only necessary that the positive locking means 25 on the bar 24 are in functional connection with the lower part 11 of the closure. Different embodiments of such closures are shown and described in the following examples although certain details can also be realized on closures where the security element 21 is functionally connected to the container 1.

Figure 3:
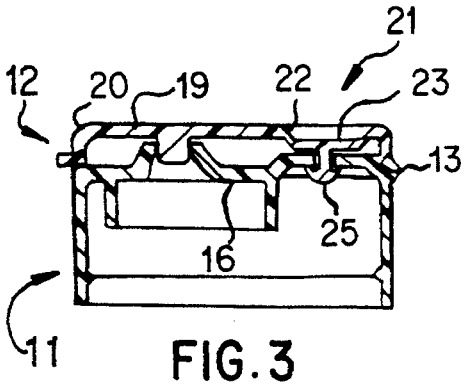
FIG. 3 is a cross-sectional side view of a plastic closure in accordance with one embodiment of this invention, wherein the security element does not change position between the security state and the state of use of the closure.

FIG. 3 shows in a simplified manner a closure in accordance with one embodiment of this invention in longitudinal section. While the lower part 11 approximately corresponds to the embodiment shown in FIGS. 1 and 2, the cap 12 connected thereto by the hinge 13 is embodied to be relatively low, that is, the casing wall 20 of the cap is relatively short. Accordingly, the security element 21 is in positive connection with the lower part 11 of the closure, but not with the container.

Figure 4:
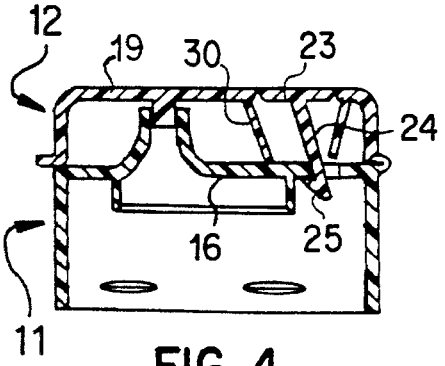
FIGS. 4 and 5 show a cross-sectional side view of a closure in accordance with another embodiment of this invention, wherein, upon the initial opening, the security element moves from an upper position in the secured state to a lower position in the state of use.
Figure 5:
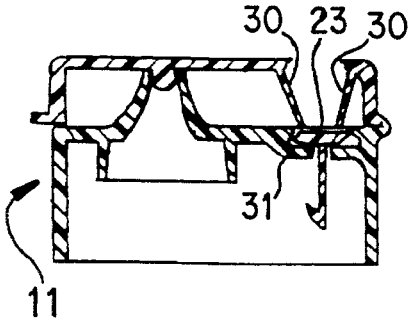

In contrast to the previously described embodiments, wherein the small plate 23 of the security element 21 is drawn downward from the secured state in the top surface 19 of the cap 12 to the top surface 16 of the lower part 11, the small plate 23 remains in the cap 12 in the embodiments of the closure shown in FIGS. 4 and 5. This requires two additional provisions. First, holding claws 32 must be disposed below the top surface 19 of the cap 12 to keep the small plate 23 in a lower position, which represents the state of use. Thus, during the initial opening movement of the entire cap 12, the bars constituting the predetermined break points 22 are destroyed. The small plate 23 glides downward between the holding claws 32 until it is stopped there again, whereupon, during the continuation of the opening movement, the bar 24 underneath the small plate 23 tears at a predetermined break point 33 especially provided for this. The torn-off bar 24 with the positive locking means 25 thus falls into the free space F between the lower part 11 and the container, not shown in this case.

Figure 6:
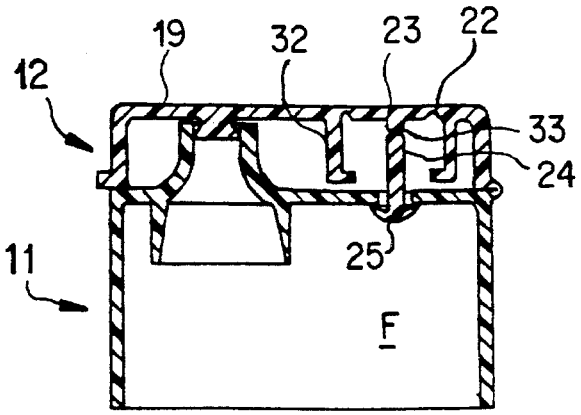
FIGS. 6 and 7 show a cross-sectional side view of a closure in accordance with one embodiment of this invention where displacement of the security element takes place after which a portion of the security element remains in the cap of the closure.
Figure 7:
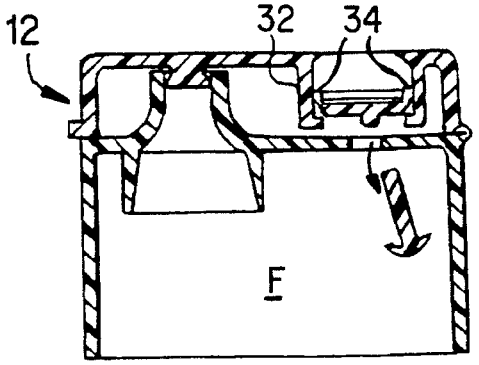

Thus, while in accordance with the embodiment of FIG. 6 the small plate 23 only remains unsecured between the holding claws 32, in accordance with the embodiment shown in FIG. 7 the holding claws 32 are additionally provided with holding burls 34, so that the small plate 23 is securely held also in the low position.

Figure 9:
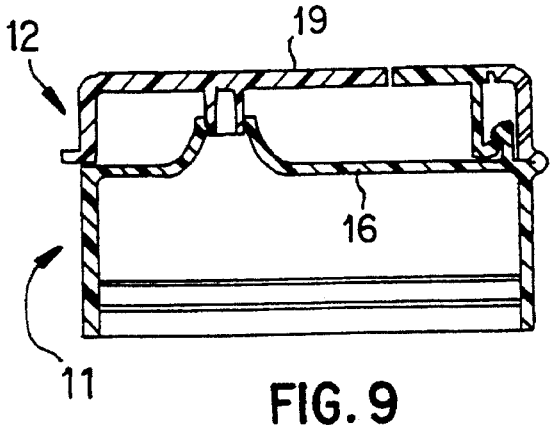
FIGS. 8 and 9 show a cross-sectional side view of a closure in accordance with another embodiment of this invention wherein the security element is pivotably disposed at the cap, FIG. 8 representing the manufacturing position and FIG. 9 representing the secured state of the closure.
Figure 8:
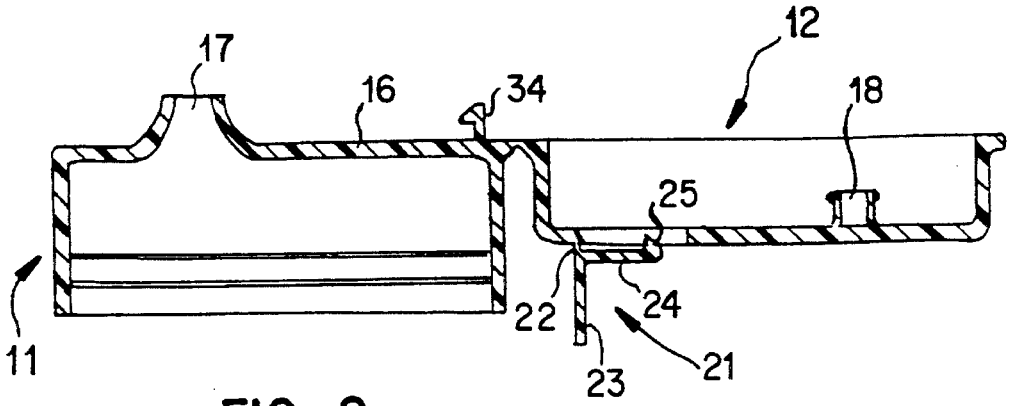

While the embodiments shown so far always require an extension of the securing element 21 through the top surface of the lower part 11, the embodiment of the closure shown in FIGS. 8 and 9 does not require such extension. Accordingly, free space below the top surface 16 of the lower part 11 is not required. Thus, the container can have an opening which in its size exactly corresponds to the lower part 11 of the closure. The manufacturing position of the closure is shown in FIG. 8. It is molded in the completely open position. Here, too, the security element 21 has a small plate 23 used as a seal, as well as a bar 24 fastened to it, having a positive locking means 25 at the end. In this case, the predetermined break points 22 are disposed on the cap 12 or the small plate 23 in such a way that the latter can be pivoted around the predetermined break points 22. In the manufacturing position in accordance with FIG. 8, the small plate 23 extends vertically from the top surface 19 of the cap 12. Accordingly, in this position the bar 24 extends parallel to the top surface 19. A hook 34 is molded on the top surface 16 of the lower part 11, the back of which can be engaged by the positive locking means 25. In a first step in the injection apparatus, the small plate 23 can be pivoted far enough around the predetermined break point 22, which is now used as a pivot point, so that the surface of the small plate 23 is flush with the top surface 19 of the cap 12. In a second step, which also takes place inside the injection apparatus, the cap 12 is pivoted closed, in the course of which pressure is simultaneously exerted on the surface of the small plate 23, so that the positive locking means 25 snaps behind the hook 34 without the small plate 23 being moved from its position. Thus, the secured state as shown in FIG. 9 is attained. With the initial opening movement of the cap 12, a pulling force is exerted on the predetermined break point 22 until it breaks. The now loose security element 21 falls on the top surface 16 of the lower part and can then be discarded.

In principle, it is possible to dispose the hook 34 on the top of the container neck and provide a corresponding recess 26 in the top surface 16 of the lower part 11, through which the hook 34 can upwardly extend beyond the top surface. However, in this case, an appropriate annular wall on the lower part 11 of the closure 10 must be provided for sealing against the container neck. It is necessary during the assembly of such a closure to make sure that the security element 21 cannot again pivot upward when placed on the container.

Figure 10:
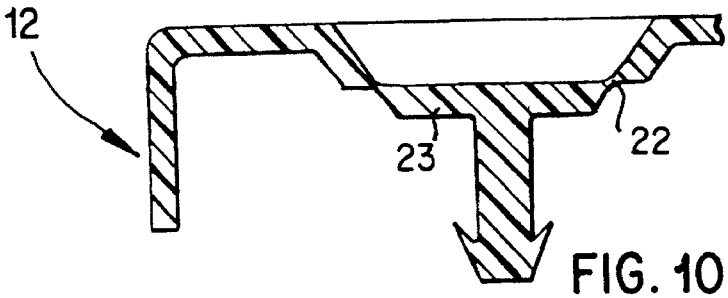
FIG. 10 shows a cross-sectional side view of a security element disposed downwardly displaced in relation to the top surface of the cap of a closure in accordance with one embodiment of this invention.
Figure 11:
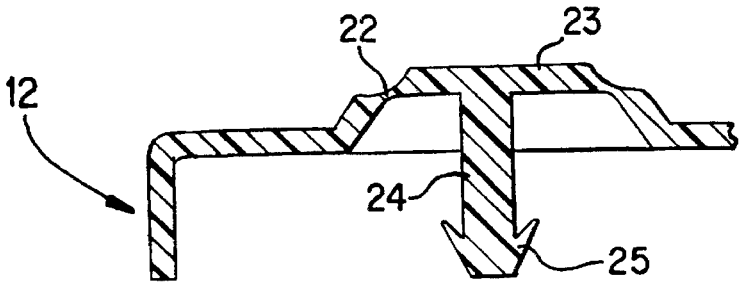
FIG. 11 shows a cross-sectional side view of a security element upwardly displaced in relation to the top surface of the cap of a closure in accordance with another embodiment of this invention.

FIGS. 10 and 11 show the possibilities for disposing the small plate 23 in respect to the top surface 19 of the cap 12 either in a downwardly displaced position, as shown in FIG. 10 in accordance with one embodiment of this invention, or in an upwardly displaced position, as shown in FIG. 11 in accordance with another embodiment of this invention. In both cases, the predetermined break points 22, rather than concrete bridges, can be formed of extremely thin circularly extending edge parts.

Figure 12:
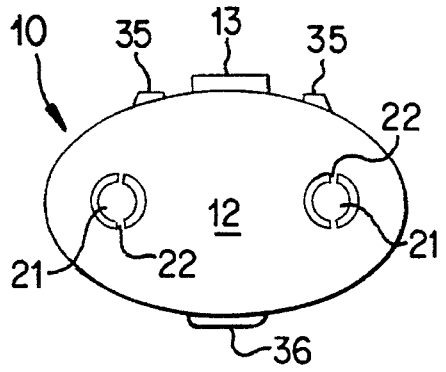
FIG. 12 shows a plan view of a closed closure in the secured state in accordance with one embodiment of this invention having two eccentrically disposed security elements.

As previously stated, the closure 10 does not need to be cylindrical in shape. A closure 10 in accordance with another embodiment of this invention is shown in each of FIGS. 12 and 13 which has an oval cross-sectional shape. The two closures, shown in the secured state, are seen in a plan view of the cap 12. A closure is shown in FIG. 12 with a centrally disposed pivot shaft in the form of a film hinge 13. Two tensioning bands 35 are disposed on both sides of the film hinge 13 which cause the snap effect of the closure. In this embodiment, two security elements 21 are located symmetrically in relation to the axes of the oval. The predetermined break points 22 are clearly visible. In the embodiment shown in FIG. 13, only a single security element is provided, asymmetrically disposed in the closure. The snap hinge is formed by two partial hinges 13 in this case, which is formed on both sides of a spring element in the form of a toggle lever 37. A pusher 36 is placed on the cap 12 on the respectively opposite side of the closure which makes opening of the closure easier. In addition to the two types of snap hinges shown, other known snap closures can also be used without limitation.

Figure 13:
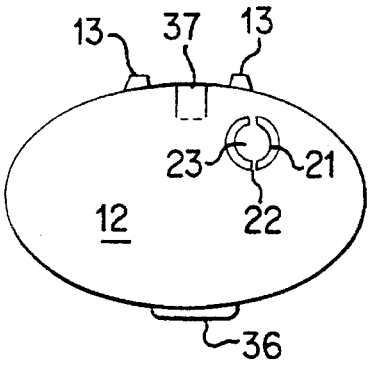
FIG. 13 shows a plan view of the closure shown in FIG. 12 but having an asymmetric disposition of a security element.
Figure 14A:
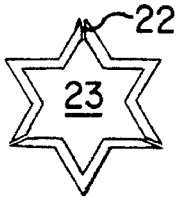
FIGS. 14–*d* show various embodiments of the shape of the seal of a security element for a closure, disposed in the recess of a cap having the same shape.
Figure 14B:
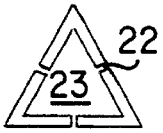
Figure 14C:
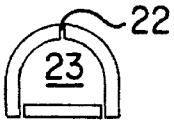
Figure 14D:
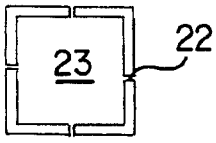

In FIGS. 1 to 11, the security element 21 is shown only in a lateral or a sectional view. Only in FIGS. 12 and 13 are the security elements 21 shown in a top view, so that the shape of the small plate 23 can be seen. In accordance with the embodiments shown in FIGS. 12 and 13, the small plates 23 are embodied as circular disks. However, this is not a requirement. FIGS. 14*a*–14*d* and 15*a* and 15*b* illustrate different examples of shapes which the small plate 23 can have. This is, of course, only a selection of different possibilities which in no way is exclusive. For example, for a closure in accordance with the embodiment shown in FIGS. 8 and 9, small plates of the shape in accordance with the embodiments of FIG. 14*c* and 14*d* in particular can be used. In this case, a straight edge of the small plate extends parallel to the hinge shaft. To assure pivotability of the small plate, predetermined break points 22 in the shape of bars may be disposed only along that straight line extending parallel to the hinge shaft.

Figure 15A:
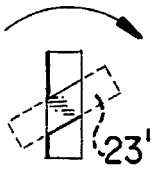
FIGS. 15*a* and 15*b* show embodiments of seal shapes after the initial opening movement of the closure in a position of use which is turned in respect to the recess in the cap.
Figure 15B:
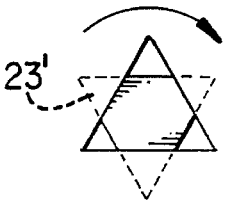

However, small plates having a shape other than round are useful if the bar 24 disposed thereunder is twisted in the course of the initial closing in the secured state of the closure, so that a torsional force acts upon it. Thus, if the predetermined break points 22 are destroyed in the course of the initial opening movement, the torsional forces relax and the small plate 23 attains a turned position of use deviating from the secured state. This situation is shown in FIGS. 15*a* and 15*b*. In FIG. 15*a*, the small plate 23 has an elongated rectangular shape. Following initial opening, the small plate moves into the turned position 23'. In this case, the recess in the top surface 19 of the cap remains partially open, as can be clearly seen, when the small plate itself does not reach a lower position.

Similar facts apply when the small plate has the shape of an equilateral triangle, as shown in FIG. 15*b*. In this embodiment, where a torsional force is utilized, the need to provide a visually discernible seal is less important because such embodiment is very much sabotage-proof. Once the security element 21 has been removed from its position in the secured state, it is practically impossible to return it to the secured state because it is necessary to again build up a torsional force during the closing process. During the initial closing following manufacture, this is accomplished by a machine, because the small plate is still fixed over the predetermined break points 22. But if this fixation is removed, this is almost impossible to realize. Such a solution is realized in a particularly elegant manner where the bar 24 is provided with a special shape at least in the lower area and where the recess 26 in the lower part 11 is provided with the same cross section, but turned by a set angle. So that, in the course of initial closing, the bar 24 attains the correct angular position in the recess 26, a feed ramp correspondingly extending in a curve on the top surface 16 of the lower part 11 is provided. But this poses no problems from the view of plastic technology.

Figure 16A:
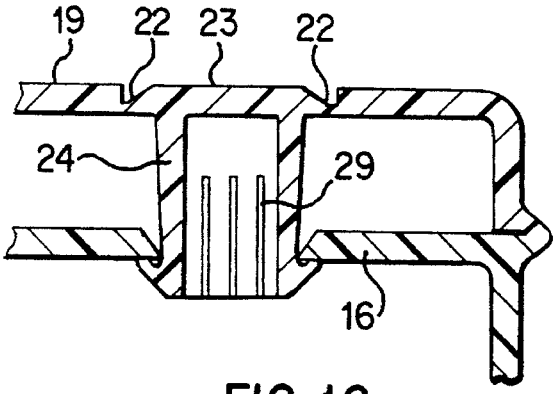
FIGS. 16*a* and 16*b* show a security element in the secured position of a closure in accordance with another embodiment of this invention, FIG. 16*b* showing a top view of the cap and FIG. 16*a* showing a cross-sectional view.
Figure 16B:
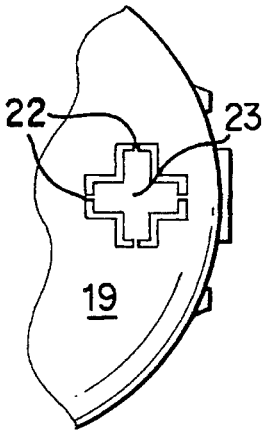

In this case, the seal surface 23 is equal in size to the cross-sectional surface of the bar 24. Thus, if the bars of the predetermined break points 22 are destroyed during the initial opening movement, the entire bar 24 falls with its seal surface 23 through the top surface 16 into the free space located thereunder. To save material, the bar 24 is hollow in accordance with the embodiment shown in FIG. 16*a*. In addition, the bar 24 is provided with longitudinal slits 29 which permit an additional spring effect, which makes sense in connection with a cross-sectional surface of the bar of that size. In the same way as previously described, the cross-sectional surface of the bar can have the same shape as the seal surface 23. A solution is shown in a partial top view in FIG. 16*b*, wherein the seal surface and the bar have a cruciform shape. In this case the bar can be solid.

Figure 17:
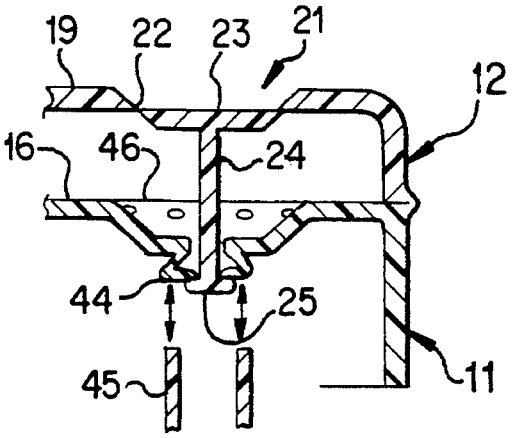
FIG. 17 shows a cross-sectional view of a security element maintained in the secured state under pre-stress.

While in the embodiments discussed so far, after the destruction of the predetermined break points 22 the security element 21 falls down onto the top surface 16 of the lower part 11 due to the force of gravity, a solution is shown in FIG. 17 where an additional spring force is utilized for this purpose. With respect to the design of the security element 21 having a small spring plate 23 and the bar 24 molded underneath it and having positive locking means 25 at the end, the embodiment shown in FIG. 17 corresponds to the previously described exemplary embodiment. However, in accordance with this embodiment shown in FIG. 17, a plurality of spring legs 44 are disposed underneath the top surface 16 of the lower part 11 in the area around the recess 26. During the initial closing of the closure inside the injection mold, the spring legs 44 are pre-stressed by a slide 45 so that they press on the positive locking means 25 in the secured state of the closure. During the initial opening movement of the closure, the tension of the spring legs 44 is initially increased by the tensile force which is fed from the positive locking means 25 to the spring legs 44. When the predetermined break points 22 finally tear, the entire security element 21 is thrown downward with great speed, where it is finally caught by holding burls 46 in a depression in the lower top surface 16 of the lower part 11.

Figure 18:
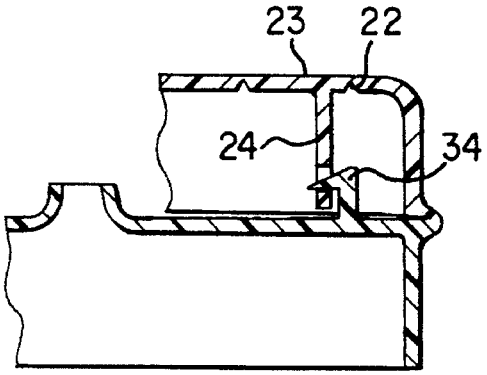
FIG. 18 shows a partial cross-sectional side view of a closure having a bar with an additional positive locking means in accordance with one embodiment of the closure of this invention.
Figure 19:
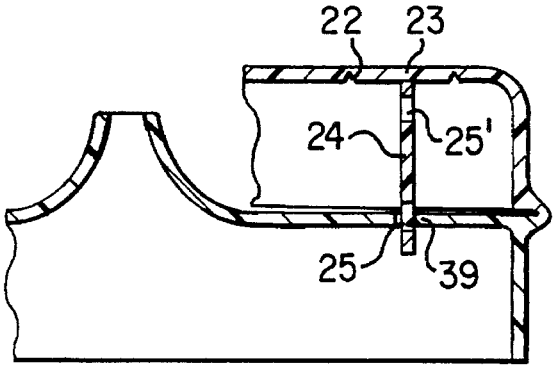
FIG. 19 shows a partial cross-sectional side view of a closure having two positive locking means for the secured and use states in accordance with another embodiment of this invention.

The design of the positive locking means 25 on the bar 24 does not necessarily have to be a hook shape, as made clear by the embodiments shown in FIGS. 18 and 19. In both cases, the bar 24 has the shape of a small spring plate formed on the underside of the small plate 23, which has only a recess 25 as the positive locking means. The hook 34 on the top surface 16 of the lower part corresponds to the embodiments shown in FIGS. 8 and 9. With this type of the positive locking means 25, such a bar can also have more than only one positive locking means, for example two recesses 25 and 25' disposed above each other in the bar, as shown in FIG.

Figure 20:
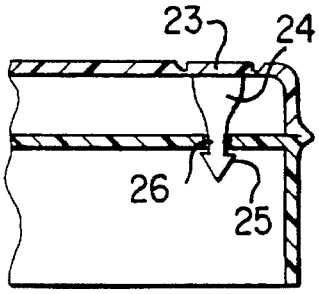
FIG. 20 shows a partial cross-sectional view of a closure with a twisted security element in accordance with one embodiment of this invention.
Figure 21:
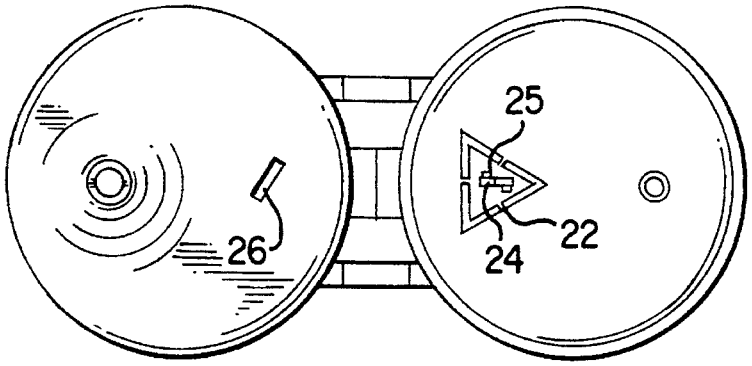
FIG. 21 shows the closure shown in FIG. 20 in the manufacturing position.

19. If, during the initial opening, the small plate 23 is torn out of the cap, it can then be pressed onto the top surface of the lower part. The top surface of the lower part again has a corresponding recess which is engaged by the bar. A claw 39 in the plane of the top surface and made of one piece with it then engages the upper or lower recess 25 or 25' in both the secured state and the state of use of the closure. Particularly when security elements 21 are used which operate under torsion, as shown by the examples in accordance with FIGS. 14 and 15, the recess 26 does not necessarily have to lie congruently under the bar 24. The embodiments shown in FIGS. 20 and 21 make this clear. The bar 24, again designed as a small spring plate, ends in a point directed toward the recess. Now, if the recess 26 is formed as a slit, the bar 24 twists during the initial closing, as shown in FIG. 20. FIG. 20 represents a top view of a completely opened closure in the manufacturing position, wherein the lower part is seen from above and the cap from the inside.

Figure 22A:
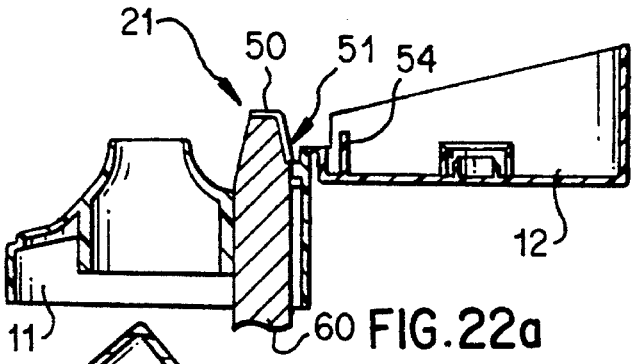
FIGS. 22–*i* show a hinged plastic closure in different positions during manufacture (FIGS. 22*a*–*d*), in the secured state (FIG. 22*e*), and in the different closed positions after initial opening of the closure (FIGS. 22*f*–*i*).
Figure 22B:
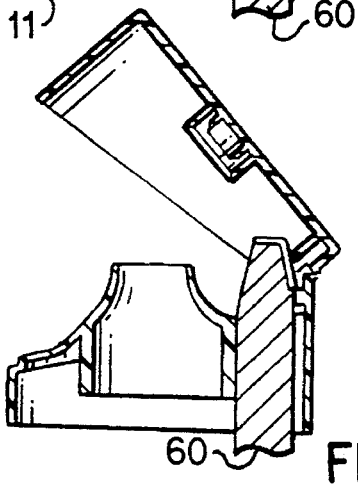
Figure 22C:
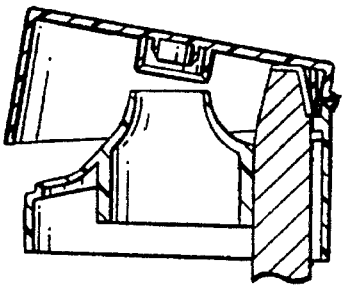
Figure 22D:
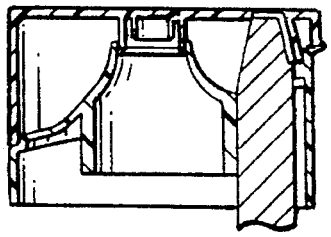
Figure 22E:
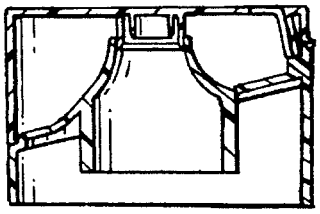
Figure 22F:
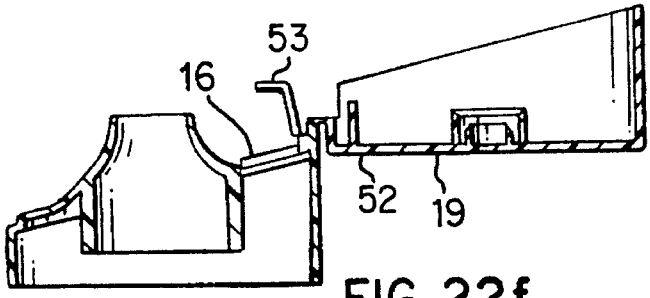
Figure 22G:
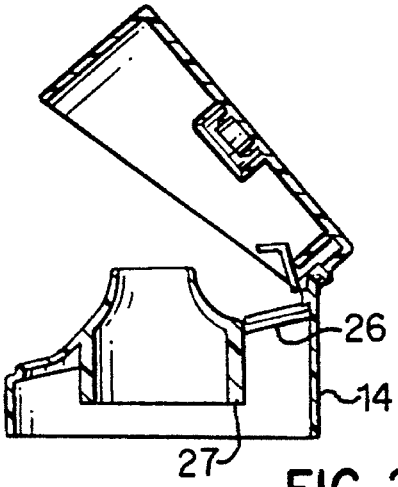
Figure 22H:
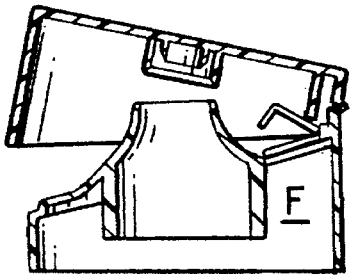
Figure 22I:
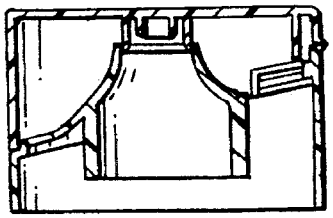

In accordance with the previously described embodiments, the security element 21 in the secured state is respectively fixedly connected with the cap 12 of the closure 10. In accordance with the embodiment shown in FIG. 22, the security element 21 has the shape of a pivotable lever 50 which is movably connected to the lower part 11 by a pivot shaft 51. A through-hole 52 is provided in the top surface 19 of the cap 12, having the same size as the pivot arm surface 53. At the completion of the extrusion process, the closure is in the position shown by FIG. 22*a*. In this position, a portion of the injection core 60 remains in the original injection position, while the cap 12 is mechanically closed while still inside the injection apparatus. In this way, part of the injection core 60 supports the pivot lever 50 until the closure is completely closed, as shown in FIG. 22*d*, and the lever arm surface 53 is located exactly in the through-hole 52 of the cap 12. Only then is the injection core part 60 removed and the closure 10 is in the secured state as shown in FIG. 22*e*. A baffle 54 in the form of a small spring plate is disposed directly next to the through-hole 52 on the inside of the top surface 19 of the cap 12. This baffle 54 is pre-stressed during initial closing, during the course of which it moves along the pivot lever 50 and finally rests against the pivot lever 50 with pre-stressing. It is unable to push the pivot lever 50 sideways during the initial closing process in the injection mold, because the pivot lever 50 is still supported by the injection core part 60. This can be seen in FIGS. 22*b* and 22*c*. The position of the pivot lever in the through-hole 52, in which it is supported by being slightly canted, is assured in spite of the pre-stressed pressure of the small spring plate 54 against the pivot lever 50. During the initial opening movement, the pivot arm surface 53 is pulled out of the through-hole 52 and the small spring plate 54, which is pre-stressed, simultaneously pushes the pivot lever 50 slightly in the direction toward the lower part 11. Due to a certain restoring force, the pivot lever 50 is able to turn approximately back into the original position, as shown in FIG. 22*f*. The visually recognizable state of use is attained, even upon initial opening, because the through-hole 52 is now uncovered. During subsequent closing of the closure after initial opening, the secured state in accordance with FIG. 22*e* can no longer be attained. During subsequent closing, the baffle 54 now again presses on the pivot lever 50, but since the supporting effect of the injection core part 60 is no longer effective, the pivot lever 50 is automatically pushed down toward the lower part 11. The recess 26, through which the injection core part 60 extends during manufacture and initial closing, is now open. Thus it is possible for the pivot lever 50 to be pushed downward by the baffle 54 toward the lower part 11 far enough that the pivot lever 50 pivots into the recess 26 and completely closes it off in the position of use in accordance with FIG. 22*i*. Accordingly, no predetermined break points are required with this embodiment. However, it is necessary again with this embodiment that there be a free space F below the top surface 16 of the lower part 11 between the casing wall 14 and the sealing annular wall 27 around the spout 17.

The numerous exemplary embodiments are intended to show the varied possibilities of the general inventive concept. In each of the embodiments, however, there is a security element 21 which attains a visually recognizable different position or shape upon the initial opening movement of the closure, without any additional manipulation being required other than the opening movement of the closure. Accordingly, it is unimportant whether the security element 21 is connected in one piece to the cap 12 or the lower part 11 in the secured state. The type of movement made by the security element during the initial opening is also different. This may be a more or less vertical translational movement or a rotating movement around a horizontal axis or a vertical axis.

I claim:

1. In a one-piece plastic closure for fastening on a container comprising a lower part with a top surface, said top surface forming a pouring opening, a cap pivotally connected to said lower part by a hinge shaft, and a security element integrally connected to the closure, the improvement comprising: at least one said security element disposed on said closure, said at least one said security element being automatically transformed from a secured state into a visually recognizable unsecured state during an initial opening movement of one of said cap away from said lower part of the closure and said entire closure away from said container; and at least one baffle disposed on an underside of said cap which, after initial opening of said closure, during closing presses said at least one said security element into a low position on the lower part of said closure.

2. In a one-piece plastic closure in accordance with claim 1 having an outwardly circularly extending fastening bead on a container neck, wherein, in said secured state, said at least one said security element is in functional connection with said fastening bead in a positively locking manner, whereby in the course of said initial opening movement of the entire closure and during said initial opening movement of the cap in relation to the lower part of the closure, said at least one said security element automatically moves from the secured state into said visually recognizable unsecured state.

3. In a one-piece plastic closure in accordance with claim 1, wherein a receptacle with at least one holding element is disposed on the lower part of said closure, into which said at least one said security element is pressed by said baffle on the cap during closing of the closure.

4. In a one-piece plastic closure in accordance with claim 1, wherein the closure is a snap-hinge closure.

5. In a one-piece plastic closure in accordance with claim 1, wherein a receptacle having a holding element is disposed on the lower part of the closure located in the area of a recess, whereby during initial closing of the closure, after opening, said at least one said security element is pressed by said baffle out of the secured position into a position in which said at least one said security element is held in said holding element and covers the recess.

6. In a one-piece plastic closure in accordance with claim 1, wherein said at least one said security element is functionally connected in at least a positively locking manner with the lower part of the closure whereby, by pivoting around a main axis, said at least one said security element automatically attains said visually recognizable unsecured state during the initial opening movement of the cap.

7. In a one-piece plastic closure in accordance with claim 6, wherein said at least one said security element is a small plate pivotally disposed in the top surface of the cap by said at least one predetermined break point, said at least one said security element having a hook-shaped positive locking means on its underside which, in the secured state, engages a corresponding counter-hook on the top surface of the lower part.

8. In a one-piece plastic closure in accordance with claim 7, wherein, in the secured state, the hook on the lower part engages the positive locking means embodied as an opening in a bar.

9. In a one-piece plastic closure in accordance with claim 6, wherein said at least one said security element is disposed movably on the lower part and in the secured position covers an opening in the cap.

10. In a one-piece plastic closure in accordance with claim 9 further comprising said baffle disposed on said underside of the cap which, during the initial opening of the closure, pivots said at least one said security element around a hinge towards the lower part of said closure.

11. In a one-piece plastic closure in accordance with claim 9, wherein a bar forms two openings as a positive locking means, and wherein a claw is provided in the top surface of the lower part which extends into a recess and through the openings in both the secured state and the unsecured state.

12. In a one-piece plastic closure in accordance with claim 1, wherein, in the secured state, said at least one said security element is connected to the top surface of the cap by at least one predetermined break point.

13. In a one-piece plastic closure in accordance with claim 12, wherein said at least one said security element comprises plate which, in the secured position, is connected flush with the top surface of the cap by said at least one predetermined break point.

14. In a one-piece plastic closure in accordance with claim 13, wherein the plate is secured on the cap by said at least one predetermined break point whereby, in the secured position, said plate-is located at a distance above the top surface of the lower part and, after the destruction of said at least one predetermined break point during the initial opening movement, falls at least approximately to the level of the top surface of the lower part.

15. In a one-piece plastic closure in accordance with claim 13 further comprising a plurality of said predetermined break points, each of said predetermined break points being disposed at a different distance from the hinge shaft.

16. In a one-piece plastic closure in accordance with claim 13, wherein, in the secured state, the plate of said at least one said security element is nonaligned with the top surface of the cap.

17. In a one-piece plastic closure in accordance with claim 16, wherein, in relation to the top surface of the cap, the plate is disposed downwardly shifted to such an extent that in the secured state it rests on the lower part of said closure and remains there in the unsecured state.

18. In a one-piece plastic closure in accordance with claim 13, wherein, on an underside of said plate, a bar with a positive locking means is disposed, said bar engaging or extending through a recess in the top surface of the lower part of said closure.

19. In a one-piece plastic closure in accordance claim 18, wherein a receptacle having a holding element is disposed on the lower part of the closure located in the area of the recess, whereby, during initial closing of the closure, after opening, said at least one said security element is pressed by said baffle out of the secured position into a position in which said security element is held in said holding element and covers the recess.

20. In a one-piece plastic closure in accordance with claim 18, wherein a holding member is disposed on the underside of the cap and said bar, which is connected by said at least one predetermined break point to the plate, pulls the plate into the holding member during the initial opening movement, and, during the continued opening movement, the bar is removed from the plate in an area of said at least one predetermined break point.

21. In a one-piece plastic closure in accordance with claim 18, wherein the recess in the top surface of the lower part is located in an area between the pouring opening and the hinge shaft.

22. In a one-piece plastic closure in accordance with claim 18, wherein two said recesses are disposed in the top surface of the lower part, located on a straight line extending parallel to a main axis.

23. In a one-piece plastic closure in accordance with claim 18, wherein said bar is embodied as a spring plate, and the positive locking means is in the form of an opening in said bar.

24. In a one-piece plastic closure in accordance with claim 23, wherein, in the secured state, a hook on the lower part engages the positive locking means embodied as said opening in said bar.

25. In a one-piece plastic closure in accordance with claim 23, wherein said bar forms two openings as said positive locking means, and wherein a claw is provided in the top surface of the lower part which extends into the recess and through the openings in both the secured state and the unsecured state.

26. In a one-piece plastic closure in accordance with claim 18, wherein, in the secured position, the bar is maintained by pre-stressing in the recess in the lower part.

27. In a one-piece plastic closure in accordance with claim 26, wherein at least one spring element is disposed below the top surface of the lower part in an area of the recess, said spring element maintaining the bar on the plate under pre-tension and, after the destruction of said at least one predetermined break point during the initial opening of said closure, pressing the bar with the plate downward onto the top surface of the lower part.

28. In a one-piece plastic closure in accordance with claim 26, wherein the recess is disposed in the lower part and the bar, in a resilient state, engages the recess.

29. In a one-piece plastic closure in accordance with claim 28, wherein the recess in the top surface and the bar of the small plate are disposed twisted in respect to each other.

30. In a one-piece plastic closure in accordance with claim 26, wherein the recess in the lower part and the bar at the plate have congruent cross-sectional shapes, and wherein, in the secured state, the bar engages the recess in a spring-elastically twisted manner.

31. In a one-piece plastic closure in accordance with claim 30, wherein the shape of the plate is non-circular, whereby, after the initial opening movement, the small plate is released from the cap and is turned back in accordance with a pre-stressed torsion, whereupon the plate is recognizably in a different angular position than in the secured state.

* * * * *